US012637319B2

(12) United States Patent
Fukasawa et al.

(10) Patent No.: US 12,637,319 B2
(45) Date of Patent: May 26, 2026

(54) SHEET CONVEYANCE CONTROL METHOD AND IMAGE FORMING APPARATUS

(71) Applicant: KYOCERA Document Solutions Inc., Osaka (JP)

(72) Inventors: Yuki Fukasawa, Osaka (JP); Masanori Taguchi, Osaka (JP); Ryota Kikuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 278 days.

(21) Appl. No.: 18/627,217

(22) Filed: Apr. 4, 2024

(65) Prior Publication Data

US 2024/0343521 A1 Oct. 17, 2024

(30) Foreign Application Priority Data

Apr. 13, 2023 (JP) ..... 2023-065368

(51) Int. Cl.
*B65H 39/06* (2006.01)

(52) U.S. Cl.
CPC ..... *B65H 39/06* (2013.01); *B65H 2511/415* (2013.01); *B65H 2511/416* (2013.01); *B65H 2801/27* (2013.01)

(58) Field of Classification Search
CPC ..... G03G 15/655; G03G 2215/00894; B65H 33/04; B65H 39/06; B65H 29/00; B65H 2301/43171; B65H 2511/415; B65H 2511/416; B65H 2513/10; B65H 2801/27
USPC ..... 270/58.31; 271/270
See application file for complete search history.

(56) References Cited

U.S. PATENT DOCUMENTS

| | | | | |
|---|---|---|---|---|
| 7,878,497 | B2 * | 2/2011 | Adachi | B65H 33/04 270/58.23 |
| 8,038,139 | B2 * | 10/2011 | Nishimura | B65H 39/06 270/58.23 |
| 8,157,255 | B2 * | 4/2012 | Nishimura | B65H 39/06 270/58.23 |
| 11,273,629 | B2 * | 3/2022 | Takahashi | B65H 3/0638 |
| 11,500,323 | B2 * | 11/2022 | Takahashi | G03G 15/6529 |
| 2012/0007302 | A1 | 1/2012 | Nishimura et al. | |

FOREIGN PATENT DOCUMENTS

JP 2010026506 A 2/2010

* cited by examiner

*Primary Examiner* — Leslie A Nicholson, III
(74) *Attorney, Agent, or Firm* — Alleman Hall LLP

(57) ABSTRACT

A processor causes, when the number of initial insertion sheets is one or more, an insertion conveying portion and a takeover conveying portion to operate at either one of a conveying speed that is the same as a print conveying speed corresponding to a first recording sheet and a reference conveying speed according to a magnitude relationship between the number of initial insertion sheets and an initial sheet count in conveyance of the initial insertion sheets. In addition, the processor causes a body conveying portion and the takeover conveying portion to operate at the corresponding print conveying speed in conveyance of the recording sheet irrespective of the number of initial insertion sheets.

5 Claims, 5 Drawing Sheets

SHEET CONVEYANCE CONTROL METHOD AND IMAGE FORMING APPARATUS

INCORPORATION BY REFERENCE

This application is based upon and claims the benefit of priority from the corresponding Japanese Patent Application No. 2023-065368 filed on Apr. 13, 2023, the entire contents of which are incorporated herein by reference.

BACKGROUND

The present disclosure relates to a sheet conveyance control method for effectively conveying recording sheets and insertion sheets, and an image forming apparatus.

An image forming apparatus may include a body unit, an insertion unit, and a post-processing unit. The body unit includes a printing portion which forms an image on a recording sheet. The recording sheet on which the image has been formed is conveyed to the post-processing unit.

The insertion unit conveys an insertion sheet to the post-processing unit. The post-processing unit carries out post-processing such as hole punching processing or staple processing on the recording sheet and the insertion sheet.

When the printing portion forms an image on the sheet using electrophotography, the printing portion includes a fixing device which fixes a toner image onto the sheet. A type of the recording sheet and a speed at which the recording sheet passes through the fixing device affect fixity of the toner image.

For securing favorable fixity of the toner image, a conveying speed of the recording sheet in the body unit may be changed according to the type of the recording sheet.

Meanwhile, in a unit subsequent to the body unit, a predetermined posterior conveying portion takes over the conveyance of each of the recording sheet and the insertion sheet. The posterior conveying portion takes over the conveyance of each of the recording sheet and the insertion sheet at the same speed as the conveying speeds thereof.

Further, the speed at which the insertion sheet is conveyed to a downstream device is known to be set at the same speed as the speed at which the recording sheet conveyed right before or right after that is conveyed to the downstream device. Thus, a frequency at which the conveying speed is switched is reduced. As a result, a time required for switching the conveying speed is shortened.

SUMMARY

A sheet conveyance control method according to an aspect of the present disclosure is a method of controlling conveyance of a recording sheet and an insertion sheet in an image forming apparatus. The image forming apparatus includes a body unit, an insertion unit, and a post-processing unit which is coupled to the body unit and the insertion unit. The body unit includes a printing portion which forms an image on the recording sheet and a body conveying portion which conveys the recording sheet from the printing portion to the post-processing unit. The insertion unit includes an insertion conveying portion which conveys the insertion sheet to the post-processing unit. The post-processing unit includes a takeover conveying portion which takes over the conveyance of each of the recording sheet and the insertion sheet from the body conveying portion and the insertion conveying portion, respectively. The sheet conveyance control method includes determining, by a processor, based on print job information, a number of initial insertion sheets that are each the insertion sheet to be conveyed by the insertion conveying portion before a first recording sheet is conveyed by the body conveying portion. Further, the sheet conveyance control method includes setting, by the processor, a print conveying speed that is a conveying speed of the body conveying portion based on input information including the print job information. Further, the sheet conveyance control method includes causing, by the processor, when the number of initial insertion sheets is one or more, the insertion conveying portion and the takeover conveying portion to operate at either one of a conveying speed that is the same as the print conveying speed corresponding to the first recording sheet and a preset reference conveying speed according to a magnitude relationship between the number of initial insertion sheets and a preset initial sheet count in conveyance of the initial insertion sheets. Further, the sheet conveyance control method includes causing, by the processor, the body conveying portion and the takeover conveying portion to operate at the corresponding print conveying speed in the conveyance of the recording sheet irrespective of the number of initial insertion sheets.

An image forming apparatus according to another aspect of the present disclosure includes: the body unit; the insertion unit; the post-processing unit; and the processor which realizes the sheet conveyance control method.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
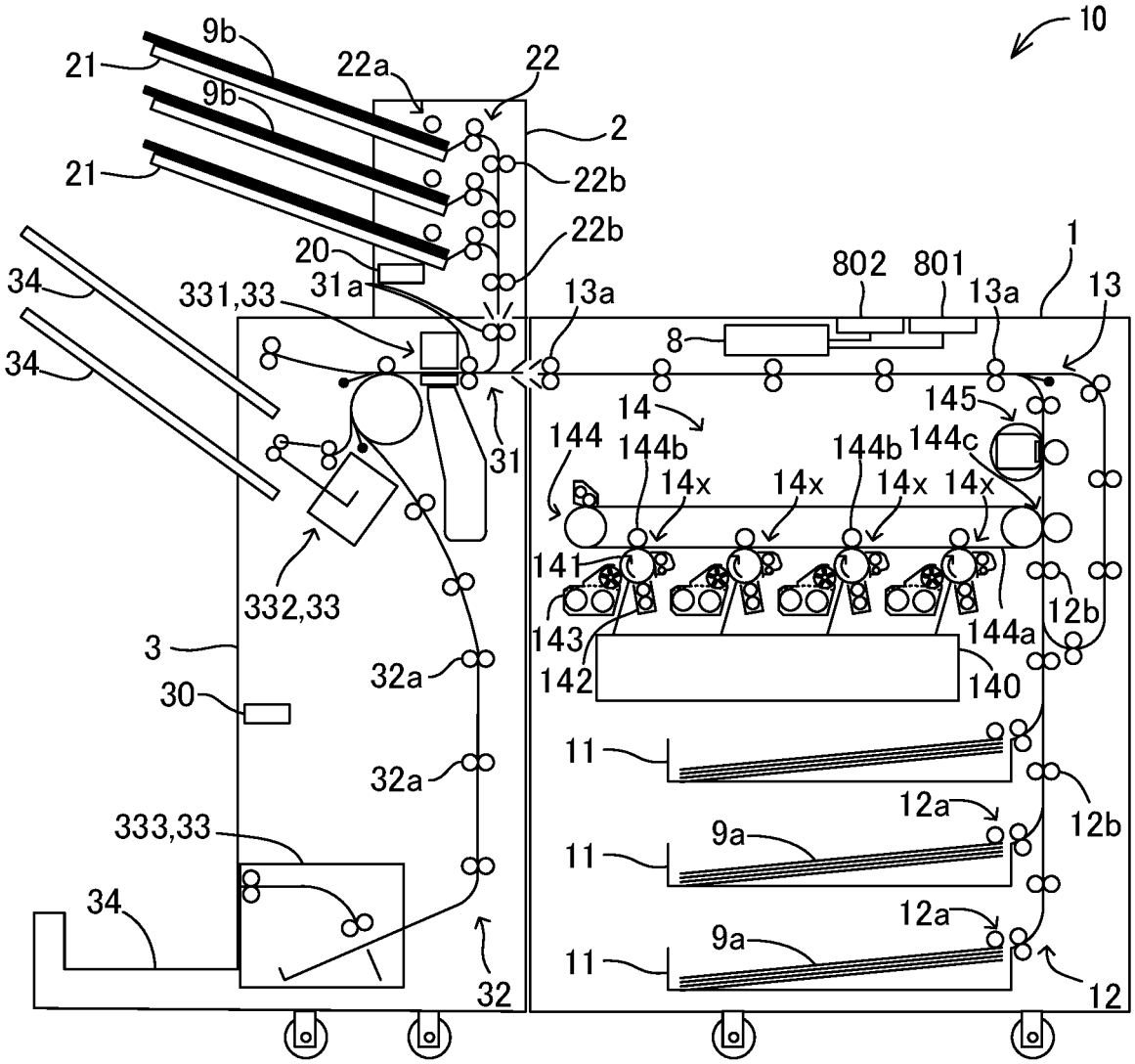
FIG. 1 is a configuration diagram of an image forming apparatus according to an embodiment.

Hereinafter, an embodiment of the present disclosure will be described with reference to the drawings. It is noted that the following embodiment is an example of embodying the present disclosure and does not limit the technical scope of the present disclosure.

[Configuration of Image Forming Apparatus 10]

An image forming apparatus 10 according to the embodiment is capable of conveying both a recording sheet 9*a* and an insertion sheet 9*b*.

The recording sheet 9*a* and the insertion sheet 9*b* are each a sheet-type member such as a paper sheet or a resin sheet. The recording sheet 9*a* is an image forming medium. The insertion sheet 9*b* is a sheet inserted before, in-between, or after the recording sheet(s) 9*a* formed with an image.

The image forming apparatus 10 includes a body unit 1, an insertion unit 2, and a post-processing unit 3. The post-processing unit 3 is coupled to the body unit 1 and the insertion unit 2. In the example shown in FIG. 1, the post-processing unit 3 is coupled to a side surface of the body unit 1. The insertion unit 2 is coupled to an upper surface of the post-processing unit 3.

[Body Unit 1]

The body unit 1 includes a plurality of recording sheet storing portions 11, a sheet feed device 12, a body conveying device 13, and a printing device 14. The body conveying device 13 is an example of a body conveying portion. The printing device 14 is an example of a printing portion.

Each of the recording sheet storing portions 11 stores recording sheets 9*a* before images are formed thereon. The sheet feed device 12 includes a plurality of sheet feed mechanisms 12*a* and a plurality of conveying roller pairs 12*b* respectively corresponding to the plurality of recording sheet storing portions 11.

Each of the plurality of sheet feed mechanisms 12*a* feeds the recording sheet 9*a* from the corresponding one of the recording sheet storing portions 11. The plurality of conveying roller pairs 12*b* respectively convey the recording sheets 9*a* fed from the recording sheet storing portions 11 to the printing device 14.

The body conveying device 13 includes a plurality of conveying roller pairs 13*a*. Owing to the rotation of the plurality of conveying roller pairs 13*a*, the body conveying device 13 conveys the recording sheet 9*a* on which an image has been formed by the printing device 14 to the post-processing unit 3.

The printing device 14 executes print processing for forming an image on the recording sheet 9*a*. In the present embodiment, the printing device 14 executes the print processing using electrophotography.

The printing device 14 includes an exposure device 140, one or more image forming portions 14*x*, a transfer device 144, and a fixing device 145. The printing device 14 shown in FIG. 1 is a tandem-type color printing device. In this case, the printing device 14 includes a plurality of image forming portions 14*x* respectively corresponding to a plurality of development colors.

In the example shown in FIG. 1, the printing device 14 includes four image forming portions 14*x* respectively corresponding to yellow, magenta, cyan, and black.

Each of the image forming portions 14*x* includes a photoconductor 141, a charging device 142, and a developing device 143. The photoconductor 141 rotates so that the charging device 142 charges a surface of the photoconductor 141.

The exposure device 140 scans laser light on the charged surface of the photoconductor 141 to write an electrostatic latent image on the surface of the photoconductor 141. The developing device 143 supplies toner to the surface of the photoconductor 141 to develop the electrostatic latent image into a toner image.

While conveying the recording sheet 9*a*, the transfer device 144 transfers the toner image formed on the surface of the photoconductor 141 onto the recording sheet 9*a*.

In the tandem-type printing device 14, the transfer device 144 includes an intermediate transfer belt 144*a*, four primary transfer devices 144*b*, and a secondary transfer device 144*c*. The four primary transfer devices 144*b* are provided in correspondence with the four image forming portions 14*x*.

The intermediate transfer belt 144*a* rotates in a state where a part thereof moves along the plurality of image forming portions 14*x*. The plurality of primary transfer devices 144*b* transfer the toner images formed on the surfaces of the photoconductors 141 of the plurality of image forming portions 14*x* onto a surface of the intermediate transfer belt 144*a*. Thus, a color toner image obtained by superimposing the toner images of the plurality of colors is formed on the surface of the intermediate transfer belt 144*a*.

The secondary transfer device 144*c* transfers the color toner image formed on the surface of the intermediate transfer belt 144*a* onto the recording sheet 9*a*. The fixing device 145 heats and pressurizes the color toner image on the recording sheet 9*a* to fix the color toner image onto the recording sheet 9*a*.

[Insertion Unit 2]

The insertion unit 2 includes one or more insertion sheet trays 21 and an insertion conveying device 22. The insertion sheets 9*b* are placed on the insertion sheet tray 21. The insertion conveying device 22 is an example of an insertion conveying portion.

The insertion conveying device 22 includes one or more sheet feed mechanisms 22*a* and a plurality of conveying roller pairs 22*b* respectively corresponding to the insertion sheet trays 21. In the example shown in FIG. 1, the insertion unit 2 includes a plurality of insertion sheet trays 21 and a plurality of sheet feed mechanisms 22*a*.

Each of the sheet feed mechanisms 22*a* feeds the insertion sheet 9*b* from each of the insertion sheet trays 21. The plurality of conveying roller pairs 22*b* convey the insertion sheets 9*b* fed from the insertion sheet trays 21 to the post-processing unit 3.

[Post-Processing Unit 3]

The post-processing unit 3 includes a takeover conveying device 31, a posterior conveying device 32, one or more sheet processing devices 33, and one or more discharge trays 34. The takeover conveying device 31 is an example of a takeover conveying portion.

In the example shown in FIG. 1, the post-processing unit 3 includes three sheet processing devices 33. The three sheet processing devices 33 include a punch device 331, a sheet binding device 332, and a sheet folding device 333.

The takeover conveying device 31 includes a plurality of conveying roller pairs 31*a*. Owing to the rotation of the plurality of conveying roller pairs 31*a*, the takeover conveying device 31 takes over the conveyance of the recording sheet 9*a* and the insertion sheet 9*b* from the body conveying device 13 and the insertion conveying device 22, respectively.

The takeover conveying device 31 conveys the recording sheet 9*a* and the insertion sheet 9*b* to the sheet processing devices 33. In the present embodiment, the takeover conveying device 31 conveys the recording sheet 9*a* and the insertion sheet 9*b* to the punch device 331.

In addition, the takeover conveying device 31 conveys the recording sheet 9*a* and the insertion sheet 9*b* that have passed through the punch device 331 to the sheet binding device 332 or the posterior conveying device 32. The takeover conveying device 31 is also capable of discharging the recording sheet 9*a* and the insertion sheet 9*b* that have passed through the punch device 331 onto one of the discharge trays 34.

The punch device 331 executes hole punching processing for punching a punch hole on the recording sheet 9*a* and the insertion sheet 9*b*.

The recording sheets 9*a* and the insertion sheets 9*b* are stacked in the sheet binding device 332, and the sheet binding device 332 binds the stacked recording sheets 9*a* and insertion sheets 9*b*. For example, the sheet binding device 332 binds the recording sheets 9*a* and the insertion sheets 9*b* by staple processing.

The sheet folding device 333 discharges the folded recording sheets 9*a* and insertion sheets 9*b* onto one of the discharge trays 34.

The posterior conveying device 32 includes a plurality of conveying roller pairs 32*a*. Owing to the rotation of the plurality of conveying roller pairs 32*a*, the posterior conveying device 32 conveys the recording sheets 9*a* and the insertion sheets 9*b* to the sheet folding device 333.

The sheet folding device 333 folds the recording sheet 9*a* and the insertion sheet 9*b*. The folded recording sheet 9*a* and insertion sheet 9*b* are discharged onto one of the discharge trays 34.

The image forming apparatus 10 further includes an operation device 801, a display device 802, and a main control device 8. The operation device 801, the display device 802, and the main control device 8 are provided in the body unit 1.

The operation device 801 is a device which accepts user operations. For example, the operation device 801 includes one or both of a touch panel and operation buttons.

The display device 802 is capable of displaying various types of information. For example, the display device 802 is a panel display device such as a liquid crystal display device. The main control device 8 controls various types of electrical equipment provided in the image forming apparatus 10.

Figure 2:
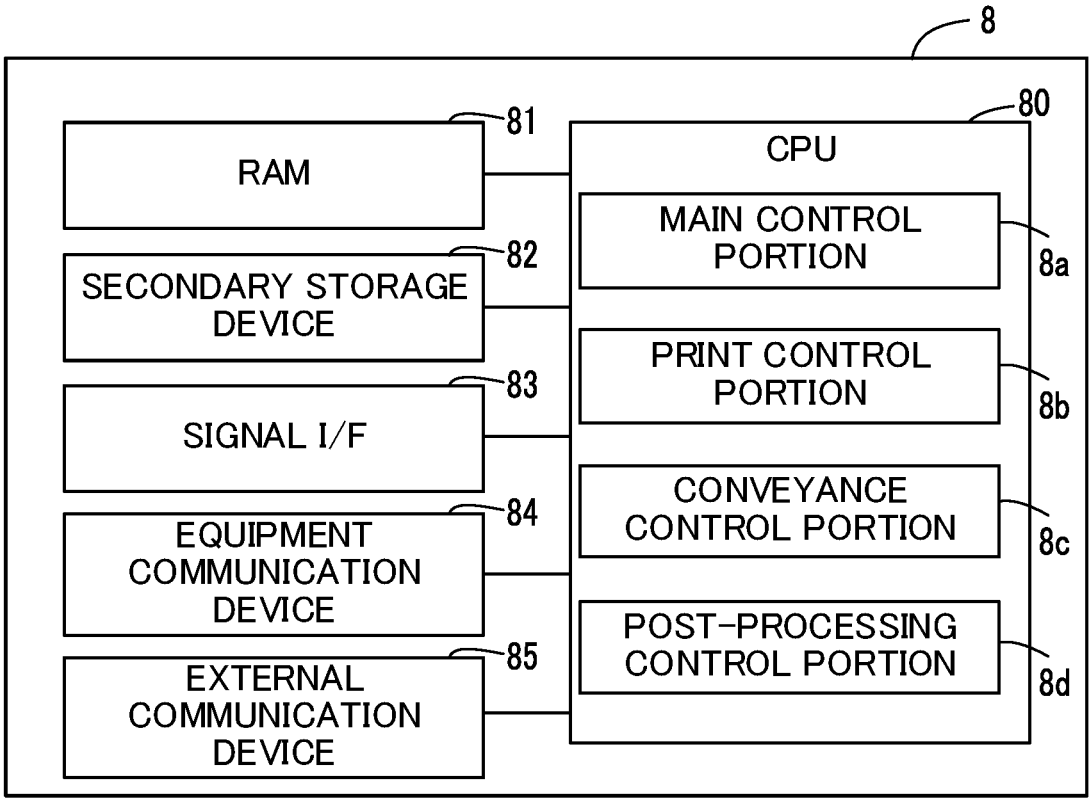
FIG. 2 is a block diagram showing a configuration of a control device in the image forming apparatus according to the embodiment.

As shown in FIG. 2, the main control device 8 includes a CPU (Central Processing Unit) 80, a RAM (Random Access Memory) 81, a secondary storage device 82, a signal interface 83, an equipment communication device 84, an external communication device 85, and the like.

The CPU 80 executes computer programs to execute various types of control and data processing. The RAM 81 temporarily stores the computer programs to be executed by the CPU 80 and various types of data.

The secondary storage device 82 is a non-volatile computer-readable storage device. The secondary storage device 82 stores the computer programs to be executed by the CPU 80 and various types of data. For example, one or both of a flash memory and a hard disk drive is/are adopted as the secondary storage device 82.

The signal interface 83 converts detection signals of various sensors into digital detection data. The detection data is transmitted to the CPU 80.

The equipment communication device 84 is an interface for equipment communication carried out between the CPU 80 and other equipment inside the image forming apparatus 10.

In the present embodiment, the insertion unit 2 includes a first local control device 20, and the post-processing unit 3 includes a second local control device 30 (see FIG. 1).

The CPU 80 carries out the equipment communication with the first local control device 20 and the second local control device 30 via the equipment communication device 84. It is noted that the CPU 80 may perform the equipment communication with the first local control device 20 via the equipment communication device 84 and the second local control device 30.

The CPU 80 outputs control commands to the first local control device 20 and the second local control device 30. The first local control device 20 controls the insertion conveying device 22 in response to the control command. The second local control device 30 controls the takeover conveying device 31, the posterior conveying device 32, and the sheet processing devices 33 in response to the control command.

In other words, the CPU 80 controls the insertion conveying device 22 via the first local control device 20. In addition, the CPU 80 controls the takeover conveying device 31, the posterior conveying device 32, and the sheet processing devices 33 via the second local control device 30.

The external communication device 85 executes communication with an external device via a network. The CPU 80 exchanges data with the external device via the external communication device 85. The external device includes a host device which request the image forming apparatus 10 to carry out the print processing. The host device is an example of an information processing apparatus.

The CPU 80 includes a plurality of processing modules that are realized by executing the computer programs. The plurality of processing modules include a main control portion 8*a*, a print control portion 8*b*, a conveyance control portion 8*c*, a post-processing control portion 8*d*, and the like (see FIG. 2).

The main control portion 8*a* executes control for causing the other processing modules to execute processing of accepting various requests and processing corresponding to the requests. For example, the main control portion 8*a* accepts a print request via the operation device 801 or the external communication device 85. In addition, the main control portion 8*a* causes the print control portion 8*b*, the conveyance control portion 8*c*, and the post-processing control portion 8*d* to execute processing corresponding to the print request.

The conveyance control portion 8*c* controls the sheet feed device 12 and the body conveying device 13 in the body unit 1. In addition, the conveyance control portion 8*c* controls the insertion conveying device 22 of the insertion unit 2 and the takeover conveying device 31 and posterior conveying device 32 of the post-processing unit 3.

The post-processing control portion 8*d* controls the sheet processing devices 33 of the post-processing unit 3.

The takeover conveying device 31 takes over the conveyance of the recording sheet 9*a* and the insertion sheet 9*b* at conveying speeds that are the same as the respective conveying speeds of the recording sheet 9*a* and the insertion sheet 9*b*.

That is, the takeover conveying device 31 takes over the conveyance of the recording sheet 9*a* at the same conveying speed as the body conveying device 13. In addition, the takeover conveying device 31 takes over the conveyance of the insertion sheet 9*b* at the same conveying speed as the insertion conveying device 22. It is noted that the same conveying speed means that circumferential speeds of the plurality of conveying roller pairs as comparison targets are the same.

Accordingly, when the conveying speed of the body conveying device 13 and the conveying speed of the insertion conveying device 22 differ, the conveying speed is switched in the takeover conveying device 31. When switching the conveying speed in the takeover conveying device 31, an adjustment of sheet conveyance intervals is necessary.

For example, the speed at which the insertion sheet 9*b* is conveyed to the post-processing unit 3 may be set to be the same as the speed at which the recording sheet 9*a* conveyed right before or right after that is conveyed to the post-processing unit 3. In this case, a frequency at which the conveying speed is switched in the takeover conveying device 31 is reduced. As a result, a time required for switching the conveying speed is shortened.

Incidentally, the conveying speeds of the recording sheets 9*a* are sequentially set for each print processing for one sheet based on input information including print job information and sheet information indicating a type of the recording sheet 9*a* stored in the recording sheet storing portion 11.

In descriptions below, the conveying speed of the recording sheet 9*a* by the body conveying device 13 will be referred to as a print conveying speed.

Further, the insertion sheet 9*b* conveyed before the first recording sheet 9*a* is conveyed in the print job will be referred to as an initial insertion sheet.

In the image forming apparatus 10, the initial insertion sheet is the insertion sheet 9*b* that is conveyed by the insertion conveying device 22 before the first recording sheet 9*a* is conveyed by the body conveying device 13. A conveying speed of the initial insertion sheet may be set to be the same as the print conveying speed for the first recording sheet 9*a*.

In such a case, when the print conveying speed for the first recording sheet 9*a* is low, the conveying speed of the initial insertion sheet is also set to be low. When the print conveying speed for the first recording sheet 9*a* is low and the number of initial insertion sheets is large, a time required for conveying all of the initial insertion sheets becomes long.

Accordingly, there is a fear that, depending on the number of consecutive insertion sheets 9*b*, the conveying speed of the insertion sheets 9*b* being set to be the same as the print conveying speed for the recording sheet 9*a* conveyed right before or right after that may rather cause lowering of sheet conveyance efficiency.

In the present embodiment, the conveyance control portion 8*c* executes sheet conveyance control to be described later. Thus, the recording sheets 9*a* and the insertion sheets 9*b* can be efficiently conveyed according to the situation.

[Sheet Conveyance Control]

Hereinafter, exemplary procedures of the sheet conveyance control will be described with reference to the flowchart shown in FIG. 3.

The conveyance control portion 8*c* executes the sheet conveyance control every time a new print job is received via the external communication device 85.

The sheet conveyance control is an example of processing of realizing a sheet conveyance control method for controlling conveyance of the recording sheets 9*a* and the insertion sheets 9*b*. The CPU 80 including the conveyance control portion 8*c* is an example of a processor which realizes the sheet conveyance control method in the image forming apparatus 10.

Figure 3:
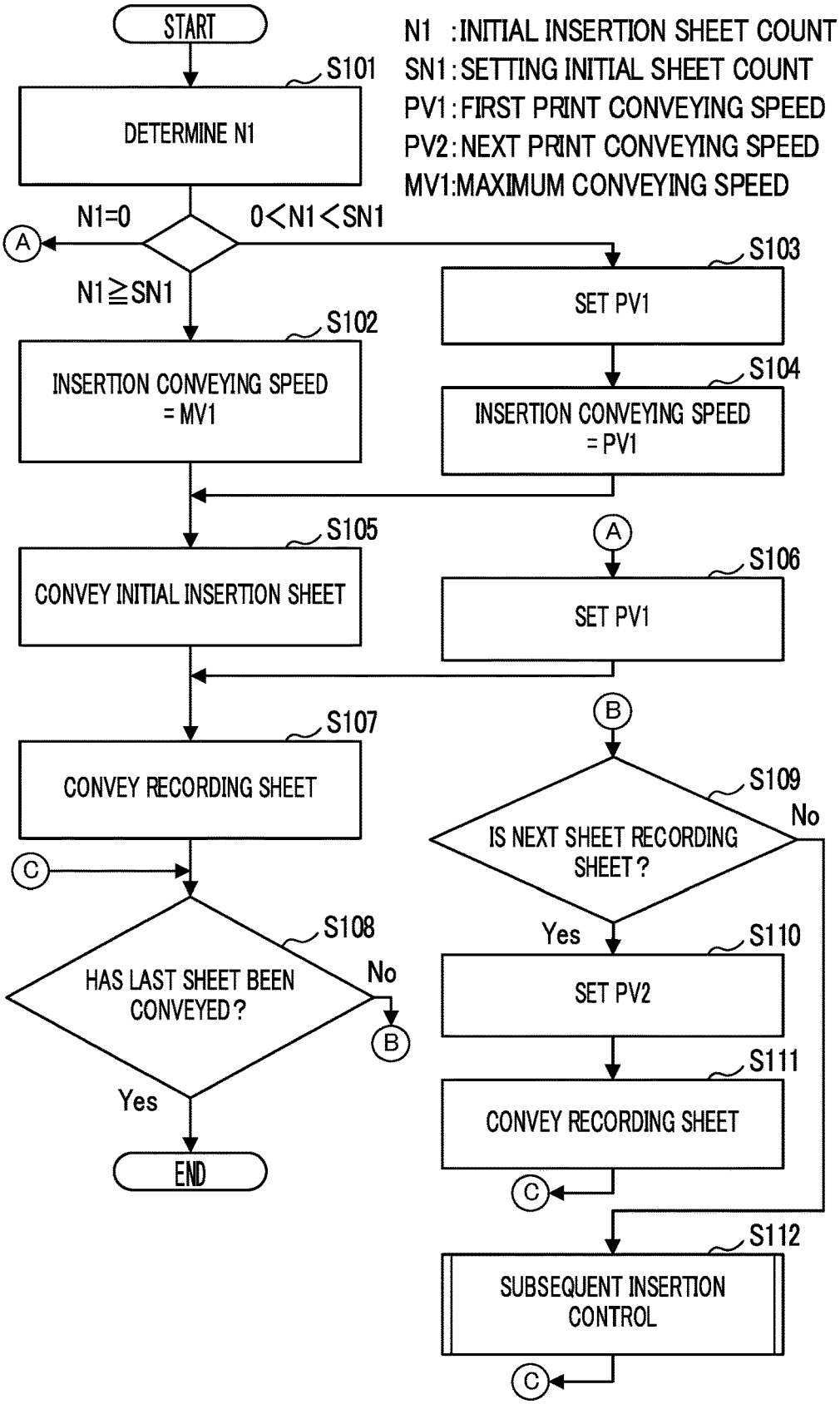
FIG. 3 is a flowchart showing exemplary procedures of sheet conveyance control in the image forming apparatus according to the embodiment.

In the flowchart shown in FIG. 3, control procedures of the sheet feed device 12 and the posterior conveying device 32 are omitted.

The conveyance control portion 8*c* sequentially specifies a conveyance target based on the print job information. The conveyance target is the recording sheet 9*a* or the insertion sheet 9*b*.

In addition, when the conveyance target is the recording sheet 9*a*, the conveyance control portion 8*c* selects a supply source of the recording sheet 9*a* from among the plurality of recording sheet storing portions 11 based on the print job information.

Further, the conveyance control portion 8*c* causes the sheet feed device 12 to execute processing of conveying the recording sheet 9*a* from the selected supply source to the printing device 14.

Furthermore, the conveyance control portion 8*c* determines whether or not the conveyance target is a target of processing by the sheet folding device 333 based on the print job information. When the conveyance target is a target of processing by the sheet folding device 333, the conveyance control portion 8*c* causes the posterior conveying device 32 to convey the conveyance target.

In descriptions below, S101, S102, . . . represent identification codes of a plurality of steps in the sheet conveyance control. In the sheet conveyance control, processing of Step S101 is executed first.

<Step S101>

In Step S101, the conveyance control portion 8*c* determines an initial insertion sheet count N1 that is the number of initial insertion sheets based on the print job information.

The conveyance control portion 8*c* executes processing of Step S102 when the initial insertion sheet count N1 is equal to or larger than a preset setting initial sheet count SN1.

The conveyance control portion 8*c* executes processing of Step S103 when the initial insertion sheet count N1 is larger than 0 and smaller than the setting initial sheet count SN1.

The setting initial sheet count SN1 is an integer of 1 or more. In the present embodiment, the main control portion 8*a* is capable of executing processing of setting an arbitrary setting initial sheet count SN1 according to a setting operation to the operation device 801.

The conveyance control portion 8*c* executes processing of Step S106 when the initial insertion sheet count N1 is 0.

<Step S102>

In Step S102, the conveyance control portion 8*c* sets an insertion conveying speed that is the conveying speed of the insertion sheet 9*b* at a maximum conveying speed MV1.

The maximum conveying speed MV1 is an example of a preset reference conveying speed. It is noted that the main control portion 8*a* may also execute processing of setting the reference conveying speed according to an operation to the operation device 801.

After executing the processing of Step S102, the conveyance control portion 8*c* executes processing of Step S105.

<Step S103>

In Step S103, the conveyance control portion 8*c* sets a first print conveying speed PV1 based on the input information. As described above, the input information includes the print job information and the sheet information. The first print conveying speed PV1 is the print conveying speed for the first recording sheet 9*a* in the print job.

The sheet information includes information related to a material, weight, and the like of the recording sheets 9*a* stored in each of the plurality of recording sheet storing portions 11.

Based on information on the first recording sheet 9*a* in the print job information, the conveyance control portion 8*c* selects the supply source of the recording sheet 9*a* from among the plurality of recording sheet storing portions 11. In addition, the conveyance control portion 8*c* sets the first print conveying speed PV1 based on information corresponding to the supply source in the sheet information.

For example, the conveyance control portion 8*c* selects the first print conveying speed PV1 out of a plurality of candidate speeds based on the information corresponding to the supply source in the sheet information. The plurality of candidate speeds include the maximum conveying speed MV1. The number of candidate speeds is considered to be about three or four.

After setting the first print conveying speed PV1, the conveyance control portion 8*c* executes the processing of Step S104.

<Step S104>

In Step S1014, the conveyance control portion 8c sets the insertion conveying speed to be the same as the first print conveying speed PV1. After that, the conveyance control portion 8c executes the processing of Step S105.

<Step S105>

In Step S105, the conveyance control portion 8c causes the insertion conveying device 22 and the takeover conveying device 31 to convey the initial insertion sheet.

In Step S105, the conveyance control portion 8c causes the insertion conveying device 22 to operate at the insertion conveying speed set in Step S102 or Step S104. In addition, the conveyance control portion 8c causes the takeover conveying device 31 to operate at the conveying speed that is the same as the insertion conveying speed.

When the initial insertion sheet count N1 is plural, in Step S105, the conveyance control portion 8c causes the insertion conveying device 22 and the takeover conveying device 31 to operate at the same conveying speed for all of the initial insertion sheets.

After executing the processing of Step S105, the conveyance control portion 8c executes processing of Step S107.

<Step S106>

In Step S106, similar to Step S103, the conveyance control portion 8c sets the first print conveying speed PV1. After that, the conveyance control portion 8c executes the processing of Step S107.

<Step S107>

In Step S107, the conveyance control portion 8c causes the body conveying device 13 and the takeover conveying device 31 to convey the first recording sheet 9a.

In Step S107, the conveyance control portion 8c causes the body conveying device 13 to operate at the first print conveying speed PV1 set in Step S103 or Step S106. In addition, the conveyance control portion 8c causes the takeover conveying device 31 to operate at the conveying speed that is the same as the first print conveying speed PV1.

After executing the processing of Step S107, the conveyance control portion 8c executes processing of Step S108.

<Step S108>

In Step S108, the conveyance control portion 8c determines whether or not the last sheet in the print job has been conveyed. The last sheet is the recording sheet 9a or the insertion sheet 9b that is conveyed last in the print job.

When determining that the last sheet has been conveyed, the conveyance control portion 8c ends the sheet conveyance control.

When determining that the last sheet has not been conveyed, the conveyance control portion 8c executes processing of Step S109.

<Step S109>

In Step S109, the conveyance control portion 8c determines which of the recording sheet 9a and the insertion sheet 9b the next sheet is based on the print job information. The next sheet is the next conveyance target in the print job.

When the next sheet is the recording sheet 9a, the conveyance control portion 8c executes processing of Step 110. On the other hand, when the next sheet is the insertion sheet 9b, the conveyance control portion 8c executes processing of Step S112.

<Step S110>

In Step S110, similar to Step S103, the conveyance control portion 8c sets a next print conveying speed PV2 based on the input information. The next print conveying speed PV2 is the print conveying speed for the recording sheet 9a that is to be conveyed next.

After executing the processing of Step S110, the conveyance control portion 8c executes processing of Step S111.

<Step S111>

In Step S111, the conveyance control portion 8c causes the body conveying device 13 and the takeover conveying device 31 to convey the next recording sheet 9a.

In Step S111, the conveyance control portion 8c causes the body conveying device 13 to operate at the next print conveying speed PV2 set in Step S110. In addition, the conveyance control portion 8c causes the takeover conveying device 31 to operate at the conveying speed that is the same as the next print conveying speed PV2.

After executing the processing of Step S111, the conveyance control portion 8c executes the processing of Step S108. Thus, the processing of Step S108 and subsequent steps is repeated until it is determined that the last sheet has been conveyed.

<Step S112>

In Step S112, the conveyance control portion 8c executes subsequent insertion control. The subsequent insertion control is control of the insertion conveying device 22 and the takeover conveying device 31 for conveying a subsequent insertion sheet. The subsequent insertion sheet is the insertion sheet 9b conveyed subsequent to the conveyance of the recording sheet 9a.

A specific example of the subsequent insertion control will be described later. After executing the processing of Step S112, the conveyance control portion 8c executes the processing of Step S108. Thus, the processing of Step S108 and subsequent steps is repeated until it is determined that the last sheet has been conveyed.

First Example of Subsequent Insertion Control

Figure 4:
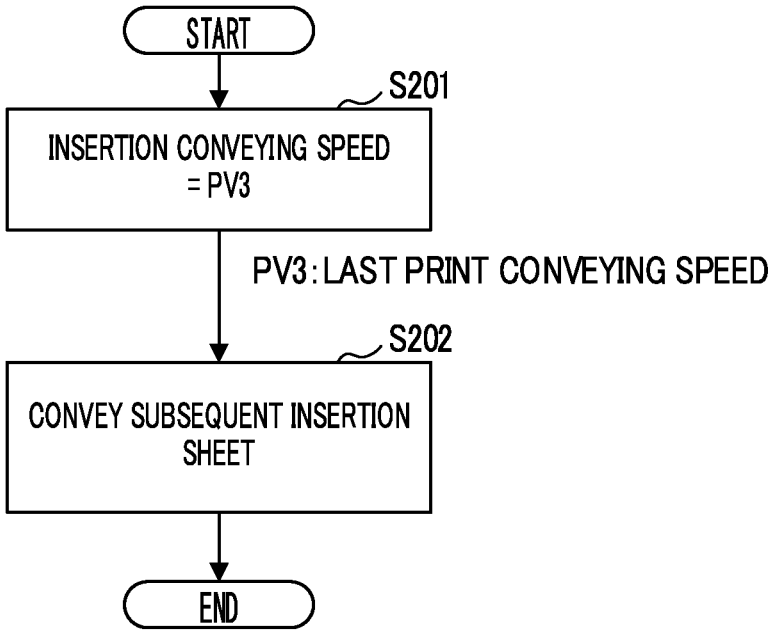
FIG. 4 is a flowchart showing a first example of procedures of subsequent insertion control in the image forming apparatus according to the embodiment.

Next, a first example of procedures of the subsequent insertion control executed in Step S112 will be described with reference to the flowchart shown in FIG. 4.

In descriptions below, S201 and S202 represent identification codes of a plurality of steps in the first example of the subsequent insertion control. In the first example of the subsequent insertion control, processing of Step S201 is executed first.

<Step S201>

In Step S201, the conveyance control portion 8c sets the insertion conveying speed to be the same as a last print conveying speed PV3.

The last print conveying speed PV3 is the print conveying speed for the recording sheet 9a that has been conveyed right before the conveyance of the subsequent insertion sheet.

After executing the processing of Step S201, the conveyance control portion 8c executes processing of Step S202.

<Step S202>

In Step S202, the conveyance control portion 8c causes the insertion conveying device 22 and the takeover conveying device 31 to convey the subsequent insertion sheet.

In Step S202, the conveyance control portion 8c causes the insertion conveying device 22 to operate at the insertion conveying speed set in Step S201. In addition, the conveyance control portion 8c causes the takeover conveying device 31 to operate at the conveying speed that is the same as the insertion conveying speed.

When there are a plurality of subsequent insertion sheets, in Step S202, the conveyance control portion 8c causes the insertion conveying device 22 and the takeover conveying device 31 to operate at the same conveying speed for all of the subsequent insertion sheets.

After executing the processing of Step S202, the conveyance control portion 8c ends the subsequent insertion control.

As described heretofore, when the initial insertion sheet count N1 is one or more, the conveyance control portion 8c executes the control of Step S102 to Step S105 in the conveyance of the subsequent insertion sheets.

In Step S102 to Step S105, the conveyance control portion 8c causes the insertion conveying device 22 and the takeover conveying device 31 to operate at either one of the two types of conveying speeds according to a magnitude relationship between the initial insertion sheet count N1 and the setting initial sheet count SN1.

The two types of conveying speeds are the first print conveying speed PV1 and the preset maximum conveying speed MV1.

Meanwhile, the conveyance control portion 8c causes the body conveying device 13 and the takeover conveying device 31 to operate at the corresponding print conveying speed in the conveyance of the recording sheet 9a irrespective of the initial insertion sheet count N1 (see Step S103, Step S107, Step S110, and Step S111).

By executing the sheet conveyance control, the insertion conveying device 22 and the takeover conveying device 31 operate at the conveying speed that is the same as the print conveying speed for the recording sheet 9a conveyed right before or right after that, as a standard operation (see Step S103 to Step S105, Step S201, and Step S202). Thus, the frequency at which the conveying speed is switched in the takeover conveying device 31 is reduced, and the recording sheets 9a and the insertion sheets 9b are conveyed efficiently.

Meanwhile, the insertion conveying device 22 and the takeover conveying device 31 may operate at the maximum conveying speed MV1 as an exceptional operation (see Step S102 and Step S105).

Specifically, when there are a large number of initial insertion sheets, the insertion conveying speed is set at the maximum conveying speed MV1 (see Step S102). Thus, a situation where a time required for conveying all of the initial insertion sheets becomes unnecessarily long due to the low first print conveying speed PV1 is avoided.

Accordingly, by adopting the sheet conveyance control, the recording sheets 9a and the insertion sheets 9b can be conveyed efficiently according to the situation.

Second Example of Subsequent Insertion Control

Figure 5:
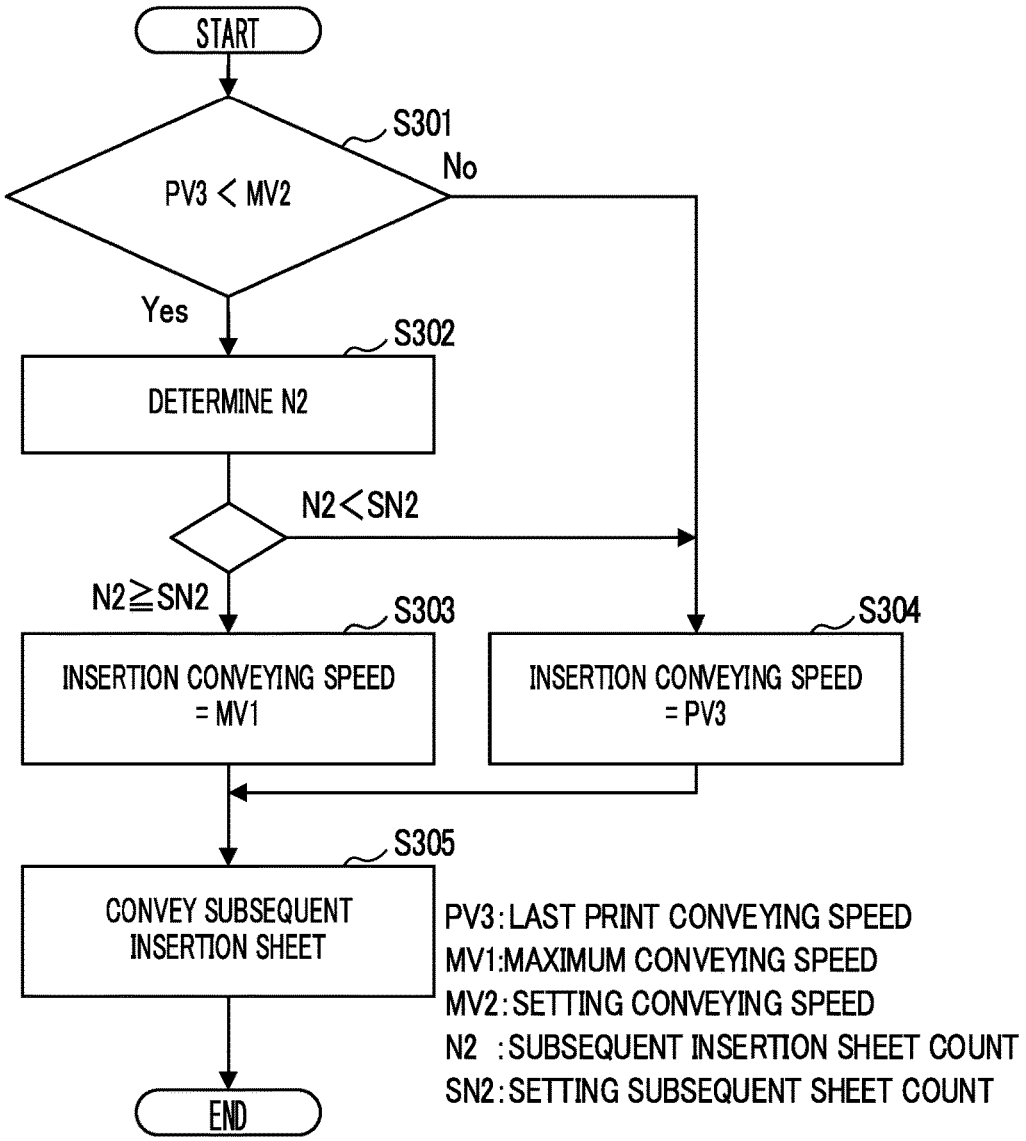
FIG. 5 is a flowchart showing a second example of the procedures of the subsequent insertion control in the image forming apparatus according to the embodiment.

Next, a second example of the procedures of the subsequent insertion control executed in Step S112 will be described with reference to the flowchart shown in FIG. 5.

In descriptions below, S301, S302, . . . represent identification codes of a plurality of steps in the second example of the subsequent insertion control. In the second example of the subsequent insertion control, processing of Step S301 is executed first.

<Step S301>

In Step S301, the conveyance control portion 8c determines processing to execute next according to the last print conveying speed PV3.

The conveyance control portion 8c executes processing of Step S302 when the last print conveying speed PV3 is smaller than a preset setting conveying speed MV2. On the other hand, the conveyance control portion 8c executes processing of Step S304 when the last print conveying speed PV3 is equal to or larger than the setting conveying speed MV2.

The setting conveying speed MV2 is an integer of 2 or more. In the present embodiment, the main control portion 8a is capable of executing processing of setting an arbitrary setting conveying speed MV2 according to a setting operation to the operation device 801.

<Step S302>

In Step S302, the conveyance control portion 8c determines a subsequent insertion sheet count N2 that is the number of subsequent insertion sheets based on the print job information. As described above, the subsequent insertion sheet is the insertion sheet 9b conveyed subsequent to the conveyance of the recording sheet 9a.

The conveyance control portion 8c executes processing of Step S303 when the subsequent insertion sheet count N2 is equal to or larger than a preset setting subsequent sheet count SN2. On the other hand, the conveyance control portion 8c executes the processing of Step S304 when the subsequent insertion sheet count N2 is smaller than the setting subsequent sheet count SN2.

<Step S303>

In Step S303, the conveyance control portion 8c sets the insertion conveying speed at the maximum conveying speed MV1. After that, the conveyance control portion 8c executes processing of Step S305.

<Step S304>

In Step S304, similar to Step S201, the conveyance control portion 8c sets the insertion conveying speed to be the same as the last print conveying speed PV3. After that, the conveyance control portion 8c executes the processing of Step S305.

<Step S305>

In Step S305, the conveyance control portion 8c causes the insertion conveying device 22 and the takeover conveying device 31 to convey the subsequent insertion sheet.

In Step S305, the conveyance control portion 8c causes the insertion conveying device 22 to operate at the insertion conveying speed set in Step S303 or Step S304. In addition, the conveyance control portion 8c causes the takeover conveying device 31 to operate at the conveying speed that is the same as the insertion conveying speed.

When there are a plurality of subsequent insertion sheets, in Step S305, the conveyance control portion 8c causes the insertion conveying device 22 and the takeover conveying device 31 to operate at the same conveying speed for all of the subsequent insertion sheets.

After executing the processing of Step S305, the conveyance control portion 8c ends the subsequent insertion control.

In Step S301 to Step S305, the conveyance control portion 8c causes the insertion conveying device 22 and the takeover conveying device 31 to operate at either one of the two types of conveying speeds in the conveyance of the subsequent insertion sheets according to the last print conveying speed PV3 and the number of subsequent insertion sheets.

The two types of conveying speeds are the last print conveying speed PV3 and the preset maximum conveying speed MV1.

By adopting the second example, when there are a large number of subsequent insertion sheets, the insertion conveying speed is set at the maximum conveying speed MV1 (see Step S303). Thus, a situation where a time required for conveying all of the initial insertion sheets becomes unnecessarily long due to the low last print conveying speed PV3 is avoided.

Accordingly, also by adopting the second example, the recording sheets 9a and the insertion sheets 9b can be conveyed efficiently according to the situation similar to the case where the first example is adopted.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveyance control method for controlling conveyance of a recording sheet and an insertion sheet in an image forming apparatus, the sheet conveyance control method comprising:

when:

the image forming apparatus includes a body unit, an insertion unit, and a post-processing unit which is coupled to the body unit and the insertion unit;

the body unit includes a printing portion which forms an image on the recording sheet and a body conveying portion which conveys the recording sheet from the printing portion to the post-processing unit;

the insertion unit includes an insertion conveying portion which conveys the insertion sheet to the post-processing unit; and the post-processing unit includes a takeover conveying portion which takes over the conveyance of each of the recording sheet and the insertion sheet from the body conveying portion and the insertion conveying portion, respectively, determining, by a processor, based on print job information, a number of initial insertion sheets that are each the insertion sheet to be conveyed by the insertion conveying portion before a first recording sheet is conveyed by the body conveying portion;

setting, by the processor, a print conveying speed that is a conveying speed of the body conveying portion based on input information including the print job information;

causing, by the processor, when the number of initial insertion sheets is one or more, the insertion conveying portion and the takeover conveying portion to operate at either one of a conveying speed that is the same as the print conveying speed corresponding to the first recording sheet and a preset reference conveying speed according to a magnitude relationship between the number of initial insertion sheets and a preset initial sheet count in conveyance of the initial insertion sheets; and causing, by the processor, the body conveying portion and the takeover conveying portion to operate at the corresponding print conveying speed in the conveyance of the recording sheet irrespective of the number of initial insertion sheets.

2. The sheet conveyance control method according to claim 1, further comprising:

setting, by the processor, the initial sheet count according to a setting operation.

3. The sheet conveyance control method according to claim 1, further comprising:

causing, by the processor, in conveyance of one or more of the insertion sheets that are conveyed subsequent to the conveyance of the recording sheet, the insertion conveying portion and the takeover conveying portion to operate at a conveying speed that is the same as the print conveying speed corresponding to the recording sheet conveyed right before the insertion sheets.

4. The sheet conveyance control method according to claim 1, further comprising:

determining, by the processor, based on the print job information, a number of subsequent insertion sheets that are each the insertion sheet to be conveyed subsequent to the conveyance of the recording sheet; and causing, by the processor, according to a last print conveying speed that is the print conveying speed corresponding to the recording sheet conveyed right before conveyance of the subsequent insertion sheets and the number of subsequent insertion sheets, the insertion conveying portion and the takeover conveying portion to operate at either one of the last print conveying speed and the reference conveying speed in the conveyance of the subsequent insertion sheets.

5. An image forming apparatus, comprising:

a body unit;

an insertion unit;

a post-processing unit coupled to the body unit and the insertion unit; and a processor which realizes the sheet conveyance control method according to claim 1, wherein the body unit includes a printing portion which forms an image on a recording sheet and a body conveying portion which conveys the recording sheet from the printing portion to the post-processing unit, the insertion unit includes an insertion conveying portion which conveys an insertion sheet to the post-processing unit, and the post-processing unit includes a takeover conveying portion which takes over conveyance of each of the recording sheet and the insertion sheet from the body conveying portion and the insertion conveying portion, respectively.

* * * * *